US009933162B2

(12) United States Patent
Inoue et al.

(10) Patent No.: US 9,933,162 B2
(45) Date of Patent: Apr. 3, 2018

(54) COMBUSTOR AND GAS TURBINE

(71) Applicant: MITSUBISHI HITACHI POWER SYSTEMS, LTD., Kanagawa (JP)

(72) Inventors: Kei Inoue, Tokyo (JP); Keijiro Saito, Tokyo (JP); Hikaru Katano, Tokyo (JP); Sosuke Nakamura, Tokyo (JP); Mitsunori Isono, Tokyo (JP); Atsushi Yuasa, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 0 days.

(21) Appl. No.: 14/762,577

(22) PCT Filed: Jan. 10, 2014

(86) PCT No.: PCT/JP2014/050360
§ 371 (c)(1),
(2) Date: Jul. 22, 2015

(87) PCT Pub. No.: WO2014/119358
PCT Pub. Date: Aug. 7, 2014

(65) Prior Publication Data

US 2015/0362193 A1 Dec. 17, 2015

(30) Foreign Application Priority Data

Feb. 1, 2013 (JP) ..... 2013-018481

(51) Int. Cl.
*F23R 3/28* (2006.01)
*F23R 3/10* (2006.01)
(Continued)

(52) U.S. Cl.
CPC ..... *F23R 3/18* (2013.01); *F23R 3/10* (2013.01); *F23R 3/16* (2013.01); *F23R 3/286* (2013.01);
(Continued)

(58) Field of Classification Search
CPC ..... F23R 3/04–3/06; F23R 3/14; F23R 3/343; F23R 3/26; F23R 3/283–3/30;
(Continued)

(56) References Cited

U.S. PATENT DOCUMENTS 5,193,346 A 3/1993 Kuwata et al.
5,251,447 A 10/1993 Joshi et al.
(Continued)

FOREIGN PATENT DOCUMENTS

CA 2 392 262 2/2007
CN 101023302 8/2007
(Continued)

OTHER PUBLICATIONS

International Search Report dated Feb. 18, 2014 in International (PCT) Application No. PCT/JP2014/050360, with English translation.
(Continued)

*Primary Examiner* — Gerald L Sung
*Assistant Examiner* — Rene Ford
(74) *Attorney, Agent, or Firm* — Wenderoth, Lind & Ponack, L.L.P.

(57) ABSTRACT

A combustor includes: a pilot burner; a plurality of main burners, each of which is provided radially and outwardly along a circumferential direction about the pilot burner, and including a main nozzle disposed in a main burner cylinder; and an extension tube provided to extend toward a downstream side from the main burner cylinder of each of the main burners. The extension tube has a circular inlet communicating with the main burner cylinder, and an outlet at the downstream side comprising two radial edges parallel to the radial direction and two circumferential edges formed along the circumferential direction so as to connect both ends of the radial edges. The combustor further includes an
(Continued)

air passage formed outside of the main burner cylinder; and an inner communication hole (formed at the side of the inlet of the extension tube and at a position corresponding to the radially and inwardly circumferential edge for allowing communication between the air passage and the inside of the extension tube.

12 Claims, 5 Drawing Sheets

(51) Int. Cl.

| | |
|---|---|
| ***F23R 3/34*** | (2006.01) |
| ***F23R 3/18*** | (2006.01) |
| ***F23R 3/16*** | (2006.01) |
| ***F23R 3/46*** | (2006.01) |
| *F23R 3/14* | (2006.01) |

(52) U.S. Cl.
CPC ..... *F23R 3/343* (2013.01); *F23R 3/46* (2013.01); *F23R 3/14* (2013.01); *F23R 2900/03343* (2013.01)

(58) Field of Classification Search
CPC ..... F23R 3/10; F23R 3/16; F23R 3/18; F23R 3/34; F23R 3/286; F02C 7/228; F05D 2260/14
See application file for complete search history.

(56) References Cited

U.S. PATENT DOCUMENTS

| | | | | |
|---|---|---|---|---|
| 6,038,861 | A | 3/2000 | Amos et al. | |
| 6,427,446 | B1 * | 8/2002 | Kraft | F23R 3/06 60/737 |
| 2003/0014975 | A1 | 1/2003 | Nishida et al. | |
| 2008/0184708 | A1 * | 8/2008 | Moriwaki | F23R 3/12 60/747 |
| 2010/0064691 | A1 * | 3/2010 | Laster | F23R 3/286 60/737 |

FOREIGN PATENT DOCUMENTS

| | | |
|---|---|---|
| CN | 101832555 | 9/2010 |
| CN | 102422083 | 4/2012 |
| JP | 3035289 | 2/2000 |
| JP | 2002-130675 | 5/2002 |
| JP | 3300754 | 7/2002 |
| JP | 2003-14232 | 1/2003 |
| JP | 2006-78127 | 3/2006 |
| JP | 3962554 | 5/2007 |
| JP | 2010-236739 | 10/2010 |
| JP | 2012-145312 | 8/2012 |
| JP | 2013-190196 | 9/2013 |

OTHER PUBLICATIONS

Written Opinion of the International Searching Authority dated Feb. 18, 2014 in International (PCT) Application No. PCT/JP2014/050360, with English translation.
Office Action dated Mar. 3, 2016 in Chinese Application No. 201480005858.5, with English translation.
Decision of a Patent Grant dated Sep. 13, 2016 in corresponding Japanese patent application No. 2013-018481 (with English translation).
Official Action dated Aug. 17, 2016 in corresponding Chinese patent application No. 201480005858.5 (with English translation).
Notice of Allowance dated Oct. 10, 2016 in corresponding Korean patent application No. 10-2015-7020230 (with partial English translation).

* cited by examiner

COMBUSTOR AND GAS TURBINE

BACKGROUND OF THE INVENTION

The present invention relates to a combustor including a burner (main burner) performing a premixed combustion, and a gas turbine using the combustor.

BACKGROUND

For example, Patent Literature 1 describes a combustor employing a premixed combustion system. This combustor includes not only a main burner performing a premixed combustion but also a pilot burner for diffusion combustion to stably keep the premixed combustion. A diffuse flame generated by the pilot burner is used as a pilot light by which the main burner generates a premixed flame, thereby keeping the premixed combustion. In a general combustor, a main burner is equally spaced in the circumferential direction radially and outwardly about a pilot burner.

The main burner includes a main nozzle and a main swirler in a cylindrical burner external cylinder (main burner cylinder). An extension tube is connected to a leading end of the burner external cylinder. The main burner mixes a fuel and air inside to generate premixed gas, and injects the generated premixed gas from the leading end of the extension tube. More specifically, the main nozzle injects a fuel to compressed air, which is supplied from a compressor (not illustrated), at an upstream side of the main swirler, and the main swirler swirls the flow of the air and the fuel. This generates premixed gas that is a mixture of air and fuel, and also generates a swirl flow of the premixed gas. The premixed gas is injected from the extension tube, and further combusted with the diffusion flame generated by the pilot burner at the downstream side of the extension tube. Thus, a premixed combustion is implemented.

Meanwhile, flashback of the main burner is likely to occur due to a low flow rate in the vicinity of an inner wall face of the extension tube. The occurrence of flashback leads to a fire damage of the combustor. Therefore, the flashback has to be prevented as much as possible. Patent Literature 1 describes that the shape of the extension tube is improved and film air is introduced from a joint portion of the burner external cylinder and the extension tube, in order to prevent the flashback. The extension tube is shaped such that an inlet is circular according to the burner external cylinder, and an outlet is formed into a trapezoid having two radial edges and circumferential edges which are a radially inward edge and a radially outward edge for connecting the respective radial edges.

Patent Literature 1: Japanese Unexamined Patent Publication No. 2006-78127

The configuration in which the outlet of the extension tube is trapezoidal and film air is introduced as described in Patent Literature 1 can prevent flashback. However, the extension tube has the circular inlet and the outlet deformed into a trapezoid, so that a high flow rate portion and a low flow rate portion are generated on the outlet of the extension tube. This might cause unevenness in the introduced film air. In addition, since flashback is likely to occur on the low flow rate portion at the outlet of the extension tube, film air is demanded to be introduced especially into this portion.

SUMMARY OF THE INVENTION

The present invention is accomplished to solve the above problems, and aims to provide a combustor and a gas turbine which can prevent unevenness of film air, while preventing an occurrence of flashback.

Solution to Problem

According to an aspect of the present invention, a combustor includes: a pilot burner; a plurality of main burners, each of which is provided radially and outwardly along a circumferential direction about the pilot burner, and includes a main nozzle disposed in a main burner cylinder; an extension tube extending toward a downstream side from the main burner cylinder of each of the main burners, including a circular inlet communicating with the main burner cylinder, and including an outlet at the downstream side formed of two radial edges parallel to the radial direction and two circumferential edges formed along the circumferential direction so as to connect both ends of the radial edges; an air passage formed outside of the main burner cylinder; and an inner communication hole formed at a position corresponding to the radially and inwardly circumferential edge on a side of the inlet of the extension tube to communicate between the air passage and an inside of the extension tube.

According to this combustor, the inner communication hole is formed, whereby air is introduced into the main burner cylinder from the air passage through the inner communication hole The air becomes film air to be flowing downward along the inner wall faces of the main burner cylinder and the extension tube. This film air reduces a fuel concentration in a low flow rate region near the wall face. Consequently, an occurrence of flashback can be prevented. Especially, the radially and inwardly circumferential edge is a portion which is close to the flame from the pilot burner and so is greatly affected by the flashback. When the film air is supplied corresponding to this portion, the occurrence of flashback can be prevented, and unevenness of film air can be prevented.

Advantageously, the combustor further includes a corner communication hole formed at a position corresponding to corners that communicate at least the radially and outwardly circumferential edge and the radial edge on the side of the inlet of the extension tube and, except for the position of the inner communication hole, to communicate between the air passage and the inside of the extension tube.

The corner where the circumferential edge and the radial edge are in communication with each other is the portion where a fluid is diffused in the radial direction from the circular inlet, and so the flow rate is particularly liable to be reduced. According to the combustor described above, the inner communication hole corresponding to the corner is formed, whereby an effect of preventing the unevenness of film air and preventing the occurrence of flashback can significantly be obtained.

Advantageously, in the combustor, the inner communication hole is continuously formed in the circumferential direction, and the corner communication hole is continuously formed in the circumferential direction at the position corresponding to the corners that communicate the radially and outwardly circumferential edge and the radial edge.

According to the combustor described above, film air is supplied based on a portion where a velocity is low. Accordingly, the combustor can significantly provide an effect of preventing the unevenness of film air and preventing the occurrence of flashback.

Advantageously, in the combustor, the inner communication hole is formed to have a larger aperture area than that of the corner communication hole.

The radially and inwardly circumferential edge is a portion which is close to the flame from the pilot burner and so is greatly affected by the flashback. In view of this, the combustor described above is preferably configured such that the inner communication hole is formed to have a larger aperture area than that of the corner communication hole in order to significantly provide an effect of preventing an occurrence of flashback.

Advantageously, in the combustor, the inner communication hole is continuously formed in the circumferential direction, and the corner communication hole is discontinuously formed in the circumferential direction.

Since the corner communication hole is discontinuously formed within the range excluding the inner communication hole, the combustor described above can supply a relatively large amount of air to the inner communication hole corresponding to the radially and inwardly circumferential edge that is the portion close to the flame from the pilot burner and so is greatly affected by flashback.

According to another aspect of the present invention, a combustor includes: a pilot burner; a plurality of main burners, each of which is provided radially and outwardly along a circumferential direction about the pilot burner, and is including a main nozzle disposed in a main burner cylinder; an extension tube extending toward a downstream side from the main burner cylinder of each of the main burners, including a circular inlet communicating with the main burner cylinder, and including an outlet at a downstream side formed of two radial edges parallel to the radial direction and two circumferential edges formed along the circumferential direction so as to connect both ends of the radial edges; an air passage formed outside of the main burner cylinder; and a corner communication hole formed at a position corresponding to corners that communicate the radially and outwardly circumferential edge and the radial edge on a side of the inlet of the extension tube.

The corner where the circumferential edge and the radial edge are in communication with each other is the portion where a fluid is diffused in the radial direction from the circular inlet, and so the flow rate is particularly liable to be reduced. According to the combustor described above, the inner communication hole corresponding to the corner is formed, whereby an effect of preventing the unevenness of film air and preventing the occurrence of flashback can significantly be obtained.

Advantageously, the combustor further includes: a plurality of main swirlers provided to radially extend in the main burner cylinder; and a vane communication hole formed at a position corresponding to the downstream end of the main swirler to communicate between the air passage and the inside of the main burner cylinder.

The flow rate is likely to be reduced and, the fuel concentration tends to be increased, at the upstream side of the main swirler. Accordingly, when the vane communication hole is formed on the position corresponding to the downstream end of the main swirler, the air introduced from the vane communication hole into the main burner cylinder can block flames of flashback.

According to still another aspect of the present invention, a gas turbine includes: a compressor; a combustor; and a turbine, and any one of the above combustor is applied.

The gas turbine described above can prevent damage on the combustor through the prevention of flashback, and therefore, can maintain turbine performance.

Advantageous Effects of Invention

According to the present invention, and unevenness of film air can be prevented while preventing an occurrence of flashback.

DETAILED DESCRIPTION OF THE INVENTION

An embodiment of the present invention will be described in detail with reference to the drawings. The present invention is not limited by the embodiment. The elements in the embodiment below include those that are easily substitutable by a person skilled in the art or that are substantially equivalents thereof.

Figure 1:
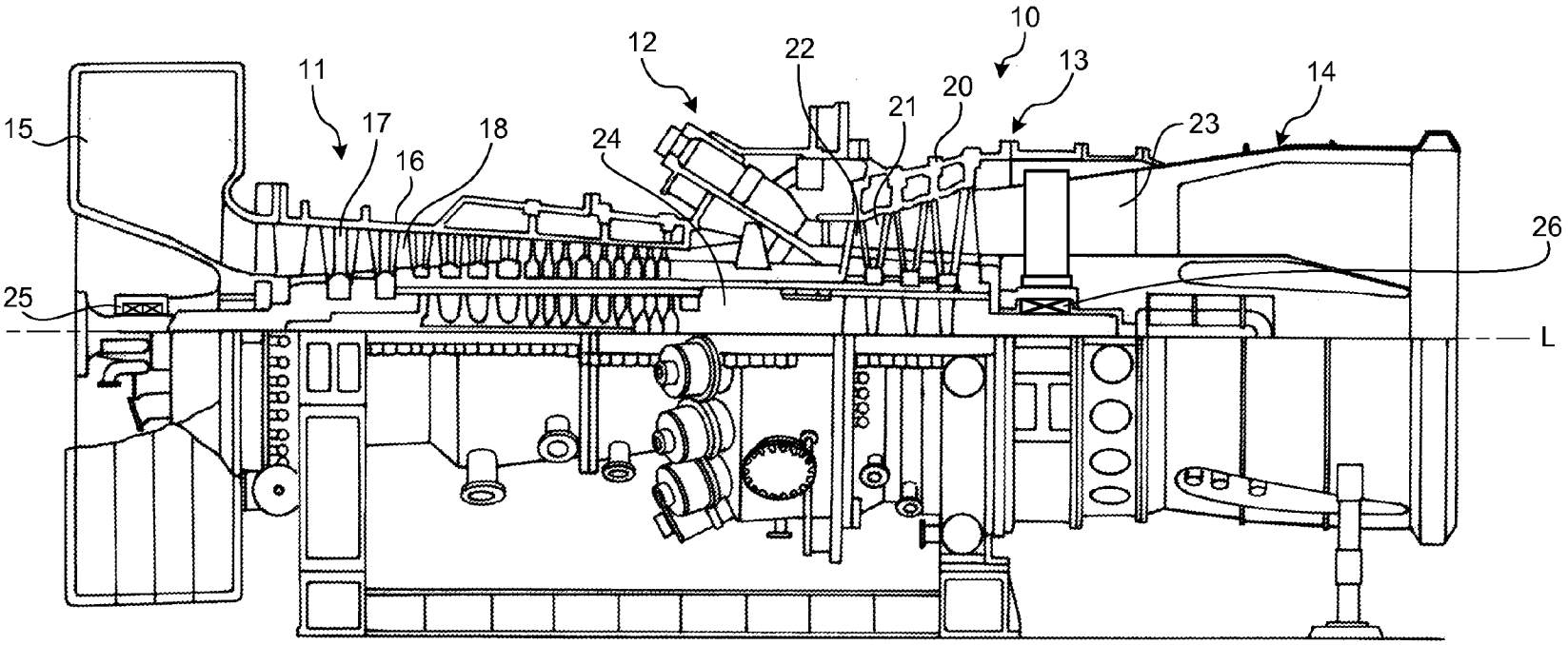
FIG. 1 is a schematic structural view of a gas turbine including a combustor according to an embodiment of the present invention.

FIG. 1 is a schematic structural view of a gas turbine including a combustor according to the present embodiment. As illustrated in FIG. 1, a gas turbine 10 includes a compressor 11, a combustor 12, a turbine 13, and an exhaust chamber 14, in the order from the upstream side in the flowing direction of fluid. A power generator not illustrated is connected to the turbine 13. The gas turbine includes a rotor 24 rotatable about a rotation axis L.

The compressor 11 has an air inlet port 15 from which air is introduced, and has a plurality of stator vanes 17 and rotor blades 18 which are provided alternately in a compressor casing 16. The combustor 12 supplies a fuel to compressed air (combustion air) compressed by the compressor 11, and can combust the air with an ignition with the burner. The turbine 13 includes a plurality of nozzles 21 and rotor blades 22 which are provided alternately in a turbine casing 20. The exhaust chamber 14 has an exhaust diffuser 23 formed continuously with the turbine 13. The rotor 24 is disposed so as to penetrate through the radially central parts of the compressor 11, the combustor 12, the turbine 13, and the exhaust chamber 14. The end of the rotor 24 at the side of the compressor 11 is supported by a bearing 25, while the end at the exhaust chamber 14 is supported by a bearing 26 so as to be rotatable about the rotation axis L. A plurality of disk plates are fixed to the rotor 24, and each of the rotor blades 18 and 22 is connected thereto. Further, a drive shaft of a power generator not illustrated is connected to the end of the rotor 24 at the side of the compressor 11.

In the gas turbine configured as described above, air introduced from the air inlet port 15 of the compressor 11 is compressed through a plurality of stator vanes 17 and rotor blades 18 to be turned into high-temperature and high-pressure compressed air. The combustor 12 supplies a predetermined fuel to this compressed air to combust the air. The high-temperature and high-pressure combustion gas that is an operating fluid generated in the combustor 12 passes through the plurality of nozzles 21 and the rotor blades 22 included in the turbine 13 to rotationally drive the rotor 24. This drives the power generator connected to the rotor 24. The exhaust gas passing through the rotor 24 is transformed into a static pressure with the exhaust diffuser 23 in the exhaust chamber 14, and then, exhausted to the atmosphere.

Figure 2:
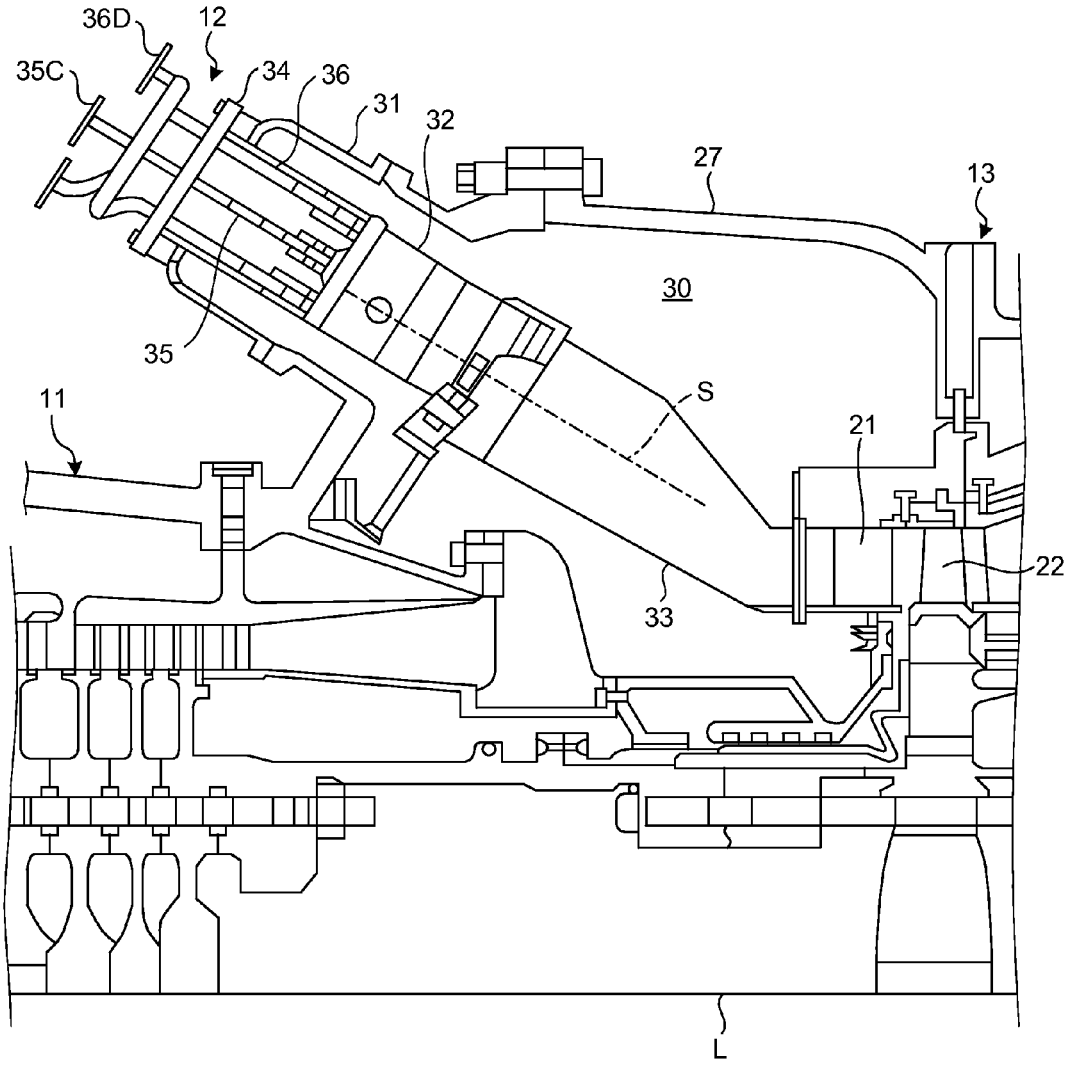
FIG. 2 is an enlarged view of the combustor in FIG. 1.

FIG. 2 is an enlarged view of the combustor in FIG. 1. In the combustor 12, an inner cylinder 32 is supported in the external cylinder 31 so as to form an air passage 30 with a predetermined space, and a transition piece 33 is connected to the leading end of the inner cylinder 32. With this, a combustor casing extending along a center axis S tilting relative to the rotation axis L is formed.

The external cylinder 31 is fixed to a casing housing 27 forming the turbine casing 20. A pilot burner 35 is provided along the center axis S at the central part of the inner cylinder 32. A plurality of main burners 36 are provided around the pilot burner 35 at the central part in the inner cylinder 32. The main burners 36 are equally spaced and parallel to the pilot burner 35 along the circumferential direction about the center axis S so as to surround the pilot burner 35 radially and outwardly about the pilot burner 35 (center axis S). The base end of the transition piece 33 is formed into a cylinder, and connected to the inner cylinder 32. The transition piece 33 is formed such that its cross-section is curved to be smaller toward the leading end, and is open toward the first-stage nozzle 21 of the turbine 13.

Figure 3:
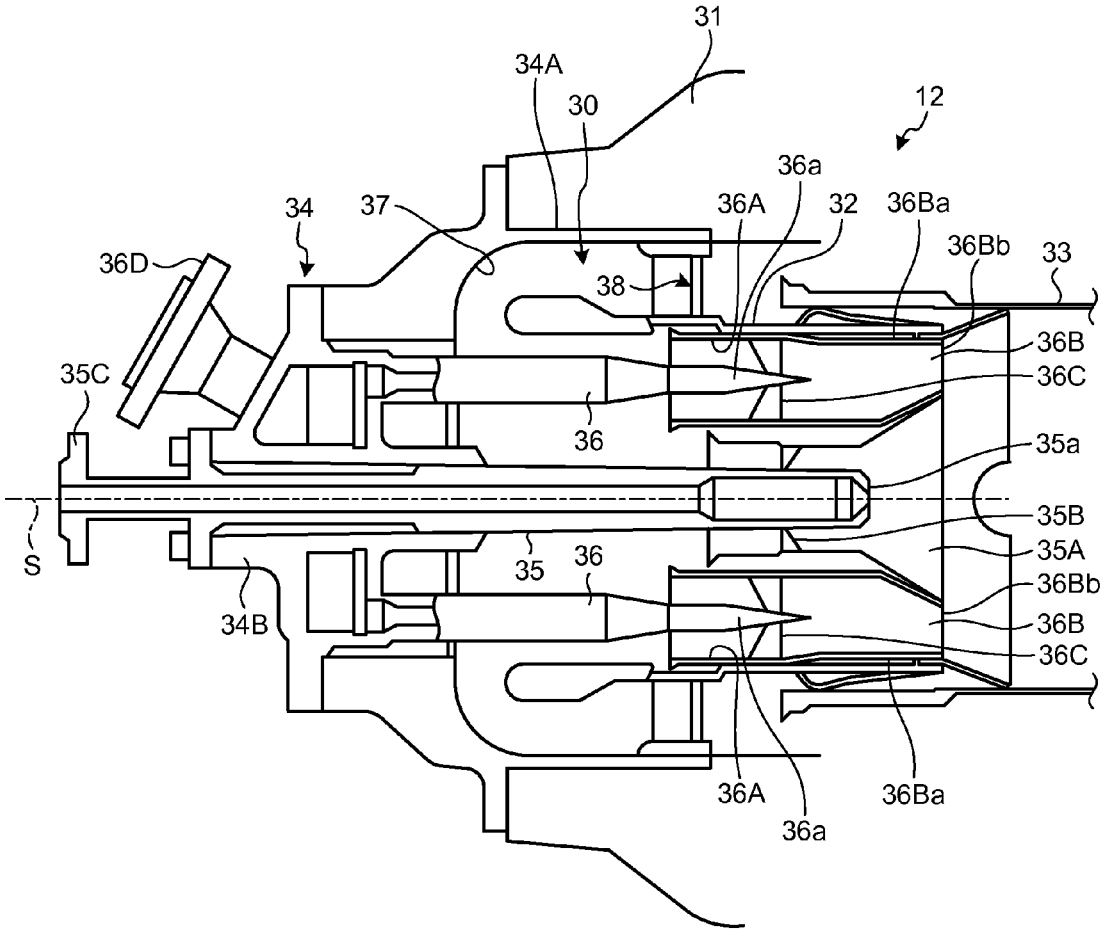
FIG. 3 is a side view schematically illustrating an internal structure of the combustor in FIG. 2.
Figure 4:
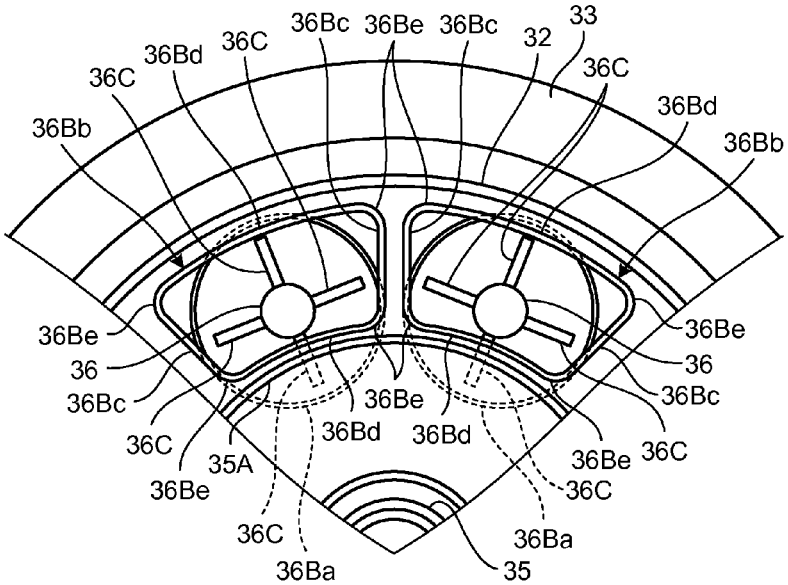
FIG. 4 is an enlarged view of a main burner in the combustor in FIG. 3 as viewed from a downstream side.
Figure 5:
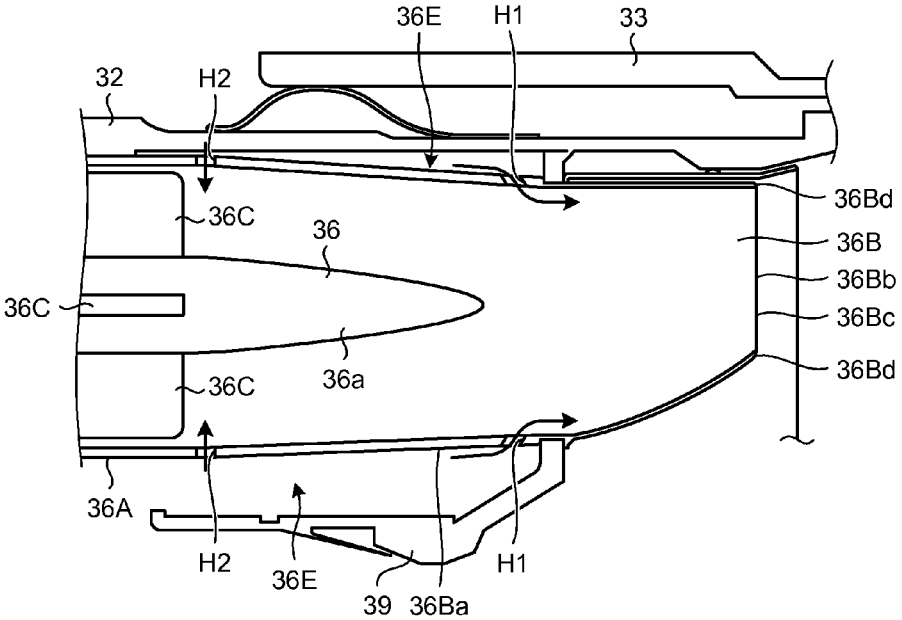
FIG. 5 is an enlarged view of the main burner in the combustor in FIG. 3.

FIG. 3 is a view schematically illustrating an internal structure of the combustor in FIG. 2. FIG. 4 is an enlarged view of the main burner in the combustor illustrated in FIG. 3 as viewed from the downstream side. FIG. 5 is an enlarged view of the main burner in the combustor illustrated in FIG. 3.

The pilot burner 35 has a pilot nozzle 35*a* formed at its tip end and disposed in a combustion cylinder 35A that is cylindrical and has a widened leading end. The pilot burner 35 also has a pilot swirler 35B disposed between its outer peripheral surface and an inner peripheral surface of the combustion cylinder 35A.

The main burner 36 has a main nozzle 36*a* formed at its tip end and disposed in a cylindrical main burner cylinder 36A. An extension tube 36B is provided to the main burner cylinder 36A at the downstream side where a fuel is injected with the main nozzle 36*a* (right side in FIGS. 3 and 5). The extension tube 36B extends downward from the main burner cylinder 36A.

As illustrated in FIGS. 4 and 5, the extension tube 36B has an inlet 36Ba in communication with the main burner cylinder 36A, and the inlet 36Ba is formed into a circular shape, similar to the main burner cylinder 36A. A downstream outlet 36Bb of the extension tube 36B is formed into a trapezoidal shape including two radial edges 36Bc which are parallel to the radial direction about the center axis S, and two circumferential edges 36Bd connecting both ends of the radial edges 36Bc along the circumferential direction about the center axis S. The circumferential edges 36Bd are the interior circumferential edge 36Bd close to the center axis S in the radial direction and the exterior circumferential edge 36Bd far from the center axis S in the radial direction. An outer corner 36Be where the radial edge 36Bc and the circumferential edge 36Bd are connected is formed into an arc. This extension tube 36B is formed to be smoothly deformed from the circular shape at the inlet 36Ba to the trapezoidal shape at the outlet 36Bb.

The main burner 36 also has a main swirler 36C disposed between the outer peripheral surface of the main nozzle 36*a* and the inner peripheral surface of the main burner cylinder 36A.

The external cylinder 31 has a top-hat portion 34 at its base end. The top-hat portion 34 is disposed along the inner peripheral surface of the base end of the external cylinder 31, and includes a cylindrical member 34A that forms a part of the air passage 30 at the outside of the external cylinder 31 and a lid member 34B that closes an opening at the base end of the cylindrical member 34A. The base end of the above pilot burner 35 is supported to the lid member 34B, and a fuel port 35C of the pilot burner 35 is disposed outside the lid member 34B. A pilot burner fuel line not illustrated is connected to the fuel port 35C to supply a fuel to the pilot burner 35. In addition, the base end of the above main burner 36 is supported to the lid member 34B, and a fuel port 36D of the main burner 36 is disposed outside the lid member 34B. A main burner fuel line not illustrated is connected to the fuel port 36D to supply a fuel to the main burner 36.

A partition wall 37 is provided at the base end of the external cylinder 31 in the cylindrical member 34A of the top-hat portion 34. With this partition wall 37, the air passage 30 is in communication with the inner cylinder 32. A straightening vane 38 is provided at the inlet portion of the air passage 30 and between the external cylinder 31 (cylindrical member 34A of the top-hat portion 34) and the inner cylinder 32. The straightening vane 38 is a porous vane formed to close the air passage 30 and to have many pores for allowing the upstream side and the downstream side of the air passage 30 to be in communication with each other.

When high-temperature and high-pressure compressed air flows into the air passage 30 in the gas turbine combustor 12 as described above, the compressed air is straightened through the straightening vane 38 and turned back by the partition wall 37 at the base end of the inner cylinder 32, thereby being guided to the combustion cylinder 35A of the pilot burner 35 and the main burner cylinder 36A of the main burner 36. The compressed air then becomes an airflow swirling with the main swirler 36C in the main burner cylinder 36A in the main burner 36, is mixed with the fuel injected from the main nozzle 36*a* in the extension tube 36B to become premixed gas, and flows into the transition piece 33. The compressed air also becomes an airflow swirling with the pilot swirler 35B in the combustion cylinder 35A in the pilot burner 35, is mixed with the fuel injected from the pilot nozzle 35*a*, combusted with an ignition with a pilot fire not illustrated to become combustion gas, and injected into the transition piece 33. In this case, a part of the combustion gas is injected so as to be diffused with flames in the transition piece 33, whereby the premixed gas flowing into the transition piece 33 from each main burner 36 is ignited and combusted.

Specifically, flame stabilization for stable combustion of the lean premixed fuel from the main burner 36 can be attained by the diffusion flame with the pilot fuel injected from the pilot burner 35. Further, the premixing of the fuel by the main burner 36 can equalize the fuel concentration to reduce NOx. In this case, the insides of the main burner cylinder 36A of the main burner 36 and the extension tube 36B become a premixing region, while the region where the premixed gas is combusted with the diffusion flame from the pilot burner 35 becomes a combustion region. The combustion region is downstream of the combustion cylinder 35A and inside the transition piece 33. Therefore, the combustion gas formed by the combustion of the premixed gas flows into the transition piece 33.

In the premixed combustor 12 as described above, the premixed gas flowing into the main burner cylinder 36A becomes a swirl flow at the downstream of the main swirler 36C. This tends to cause flashback from the combustion region to the premixing region. Specifically, the fuel injected from the main nozzle 36*a* is made uniform throughout the inside of the main burner cylinder 36A with the swirl flow. With this, the distribution of the fuel concentration is almost constant from the central part to the inner wall face of the main burner cylinder 36A. On the other hand, the velocity of the premixed gas is zero on the inner wall face, increases with distance from the inner wall face (velocity boundary layer), and becomes almost constant at the outside of the velocity boundary layer (at the central part of the main burner cylinder 36A). Specifically, the velocity boundary layer where the velocity is low is present in the vicinity of the inner wall face of the main burner cylinder 36A and the extension tube 36B, while the fuel concentration is high in the velocity boundary layer. Therefore, flashback from the combustion region is likely to occur in this velocity boundary layer.

Especially, in the present embodiment, the extension tube 36B is formed such that the inlet 36Ba is formed into a circular shape and the outlet 36Bb is formed into a trapezoidal shape. It has been found according to the study by the present inventors that a portion where a flow rate is low is generated at the outlet 36Bb of the extension tube 36B with this structure. Specifically, this phenomenon is noticeable at the portion of the radially and inwardly circumferential edge 36Bd and both of radially outward corners 36Be. Accordingly, flashback is likely to occur at the portion where the flow rate is low, and this might increase the temperature of the inner wall face of the extension tube 36B to damage the combustor 12. In order to avoid this, the main burner 36 is configured as described below in the present embodiment.

As illustrated in FIG. 5, an air passage 36E is formed at the outside of the main burner cylinder 36A. A peripheral cylinder 39 enclosing the perimeter of the main burner cylinder 36A is provided inside the inner cylinder 32, and the air passage 36E is formed between both a part of the inner peripheral surface of the inner cylinder 32 and the inner peripheral surface of the peripheral cylinder 39 and the outer peripheral surface of the main burner cylinder 36A. This air passage 36E is in communication with the air passage 30. A communication hole H1 that allows communication between the air passage 36E and the inside of the extension tube 36B is formed at the side of the inlet 36Ba of the extension tube 36B. The side of the inlet 36Ba of the extension tube 36B is the position downstream of the main nozzle 36*a* and formed into a circular shape. The communication hole H1 is obliquely formed such that the opening in the extension tube 36B faces the outlet 36Bb (downstream side) of the extension tube 36B. The communication hole H1 is formed as described below to correspond to the low flow rate portion at the outlet 36Bb of the extension tube 36B.

Figure 6:
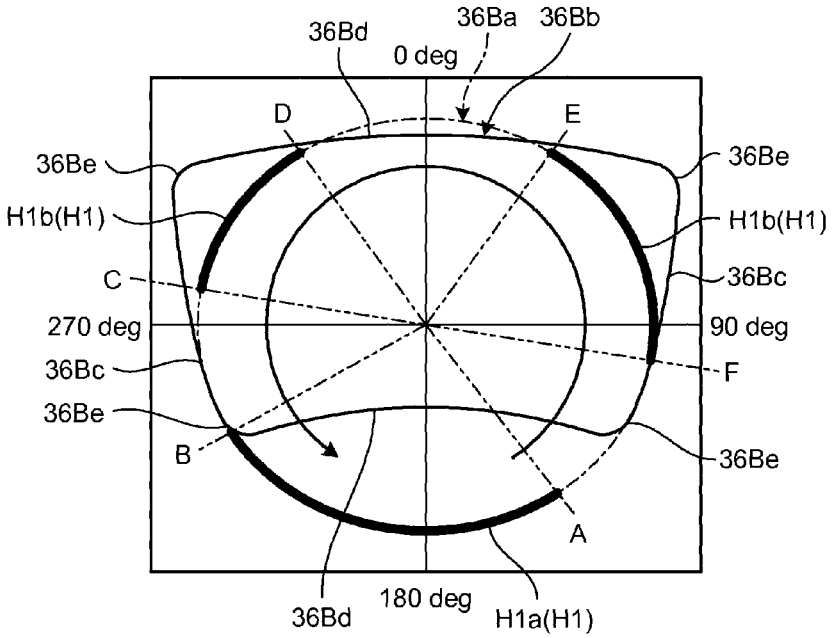
FIG. 6 is a view illustrating an arrangement of through-holes.
Figure 7:
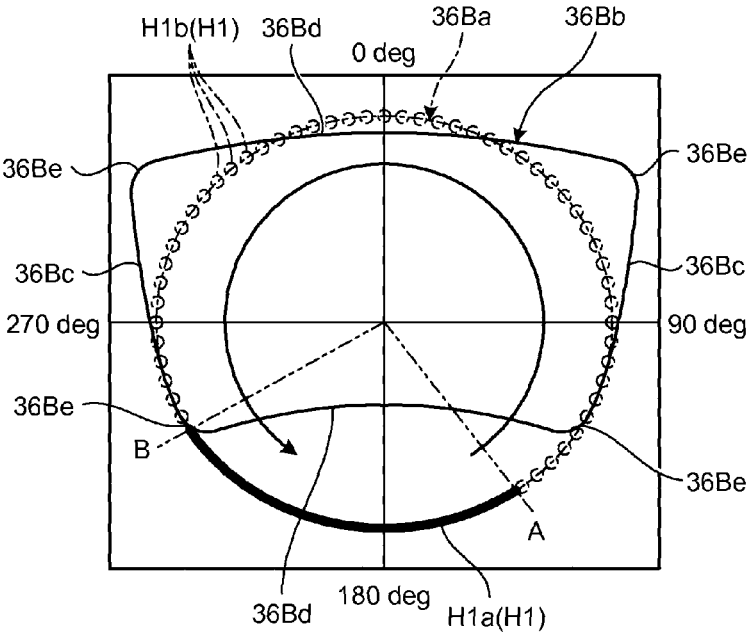
FIG. 7 is a view illustrating another arrangement of through-holes.

FIG. 6 is a view illustrating the arrangement of the through-holes (communication holes), and FIG. 7 is a view illustrating another arrangement of the through-holes. In FIGS. 6 and 7, the main burner 36 is viewed from the downstream side as in FIG. 4. The communication hole H1 is formed according to the radially and inwardly circumferential edge 36Bd and both radially outward corners 36Be at the outlet 36Bb of the extension tube 36B at the outlet 36Bb of the extension tube 36B.

In FIG. 6, the communication hole H1 is formed such that an inner communication hole H1*a* is formed to correspond to the portion of the radially and inwardly circumferential edge 36Bd, and corner communication holes H1*b* are formed to correspond to respective portions of both corners 36Be. The communication holes H1*a*, H1*b* are provided separately for each portion, and are continuously formed in the form of a slit (i.e., an elongated hole) within a predetermined range.

The predetermined range will be described. As illustrated in FIG. 6, in the case where the swirl flow is in a counterclockwise direction when the main burner 36 is viewed from the downstream side, the center of the radially and outwardly circumferential edge 36Bd is defined as zero degree. The inner communication hole H1*a* corresponding to the radially and inwardly circumferential edge 36Bd is formed within a range (i.e., an arc) between two-dot chain lines A and B in FIG. 6. The corner communication hole H1*b* corresponding to the corner 36Be (upstream side of the swirl flow (right in FIG. 6)) is formed within a range between two-dot chain lines E and F in FIG. 6. The corner communication hole H1*b* corresponding to the corner 36Be (downstream side of the swirl flow (left in FIG. 6)) is formed within a range between two-dot chain lines C and D in FIG. 6. As described above, the respective communication holes H1*a* and H1*b* are unequally provided in the circumferential direction. This arrangement is made in consideration of an influence of the swirl flow. Specifically, as described above, the premixed gas flowing in the main burner cylinder 36A becomes a swirl flow at the downstream end of the main swirler 36C. In FIG. 6, the swirl flow is in the counterclockwise direction when the main burner 36 is viewed from the downstream side. A part of the compressed air in the air passage 30 introduced from the respective communication holes H1*a* and H1*b* into the main burner cylinder 36A flows toward the downstream side while being carried by the swirl flow to circulate in the counterclockwise direction. The circumferential location of the communication holes H1*a* and H1*b* is determined based on the flow direction of the swirl flow and the influence by the distance from the respective communication holes H1*a* and H1*b* to the outlet 36Bb of the extension tube 36B. In particular, the ranges (arc lengths of the slit-shaped holes extending in the circumferential direction) of the respective communication holes H1*a* and H1*b* are shifted circumferentially in the clockwise direction opposite to the swirl flow direction, and the shift is relative to a line extending from 0 degrees to 180 degrees, as shown in FIGS. 6 and 7. As shown in the drawings, the communication holes H1*a* and H1*b* extend more than 30 degrees and less than 180 degrees in the circumferential direction. With this, at the outlet 36Bb of the extension tube 36B, air introduced from the respective communication holes H1*a* and H1*b* into the main burner cylinder 36A reaches almost the symmetric range about the central position (180 degrees) of the radially and inwardly circumferential edge 36Bd or almost the symmetric range with the narrowest part of the corner 36Be as a reference.

As illustrated in FIG. 6, with the formation of the communication holes H1, a part of the compressed air in the air passage 30 is introduced into the main burner cylinder 36A from the air passage 36E via the communication hole H1 to become film air. This film air flows toward the downstream side along the inner wall faces of the main burner cylinder 36A and the extension tube 36B as illustrated in FIG. 5. This film air reduces the fuel concentration in the low flow rate region near the wall face. This can prevent the occurrence of flashback.

The combustor 12 according to the present embodiment includes the inner communication hole H1*a* and the corner communication holes H1*b* formed to correspond to the portion where the flow rate is low at the outlet 36Bb of the extension tube 36B. This configuration can further prevent the unevenness of film air, while preventing the occurrence of flashback.

The combustor 12 according to the present embodiment can significantly provide the effect of preventing the unevenness of film air while preventing the occurrence of flashback by forming both the inner communication hole H1*a* and the corner communication hole H1*b*. Even when only one of the inner communication hole H1*a* and the corner communication hole H1*b* is formed, the effect of preventing the unevenness of film air and preventing the occurrence of flashback can be obtained. When one of the inner communication hole H1*a* and the corner communication hole H1*b* is formed, the inner communication hole H1*a* corresponding to the radially and inwardly circumferential edge 36Bd, which is the portion close to the flame from the pilot burner 35 and so is greatly affected by flashback, is preferably formed. Alternatively, when one of the inner communication hole H1*a* and the corner communication hole H1*b* is formed, the corner communication hole H1*b* corresponding to the corner 36Be where the fluid is diffused in the radial direction and so the flow rate is particularly liable to be reduced, is preferably formed.

The radially and inwardly circumferential edge 36Bd is the portion of the extension tube 36B closest to the flame from the pilot burner 35 and so is greatly affected by flashback. Therefore, when both the inner communication hole H1*a* and the corner communication hole H1*b* are formed, the inner communication hole H1*a* is preferably formed to have a larger aperture area than that of the corner communication hole H1*b* to significantly obtain the effect of preventing the occurrence of flashback.

In FIG. 7, the communication hole H1 is formed such that the inner communication hole H1*a* formed corresponding to the portion of the radially and inwardly circumferential edge 36Bd and the corner communication hole H1*b* formed corresponding to both corners 36Be are formed along the circumferential direction. In this case, the inner communication hole H1*a* is continuously formed in the form of a slit within a predetermined range, while the corner communication hole H1*b* is discontinuously formed within a range excluding the inner communication hole H1*a*.

The predetermined range will be described. As illustrated in FIG. 7, in the case where the swirl flow is in a counterclockwise direction when the main burner 36 is viewed from the downstream side, the center of the radially and outwardly circumferential edge 36Bd is defined as zero degree. The inner communication hole H1*a* corresponding to the radially and inwardly circumferential edge 36Bd is formed within a range between two-dot chain lines A and B in FIG. 7. The corner communication hole H1*b* corresponding to the corner 36Be is formed as discontinuous small holes within the remaining range. The communication hole H1*a* is unequally disposed in the circumferential direction, and this is in consideration of the influence of the swirl flow as described above.

As illustrated in FIG. 7, with the formation of the communication hole H1, a part of the compressed air in the air passage 30 is introduced into the main burner cylinder 36A from the air passage 36E via the communication hole H1 to become film air. This film air flows toward the downstream side along the inner wall faces of the main burner cylinder 36A and the extension tube 36B as illustrated in FIG. 5. This film air reduces the fuel concentration in the low flow rate region near the wall face. This can prevent the occurrence of flashback.

The combustor 12 according to the present embodiment includes the inner communication hole H1*a* and the corner communication hole H1*b* formed to correspond to the portion where the flow rate is low at the outlet 36Bb of the extension tube 36B. This configuration can provide a significant effect of preventing the unevenness of film air while preventing the occurrence of flashback. In addition, the corner communication hole H1*b* is discontinuously formed within the range excluding the inner communication hole H1*a*. With this, a relatively large amount of air can be supplied to the inner communication hole H1*a* corresponding to the radially and inwardly circumferential edge 36Bd that is the portion close to the flame from the pilot burner 35 and so is greatly affected by flashback.

Meanwhile, the flow rate is likely to be reduced, so that the fuel concentration tends to be increased, at the upstream side of the main swirler. When a vane communication hole H2 is formed on the position corresponding to the downstream end of the main swirler, the compressed air is introduced from the vane communication hole H2 into the main burner cylinder 36A, and this compressed air can block flames of flashback.

Furthermore, the gas turbine 10 having the above combustor 12 can prevent damage on the combustor 12 because of the prevention of flashback, and therefore, can maintain turbine performance.

REFERENCE SIGNS LIST

10 GAS TURBINE
11 COMPRESSOR
12 COMBUSTOR
13 TURBINE
35 PILOT BURNER
36 MAIN BURNER
36*a* MAIN NOZZLE
36A MAIN BURNER CYLINDER
36B EXTENSION TUBE
36Ba INLET
36Bb OUTLET
36Bc RADIAL EDGE
36Bd CIRCUMFERENTIAL EDGE
36Be CORNER
36C MAIN SWIRLER
36E AIR PASSAGE
H1*a* INNER COMMUNICATION HOLE
H1*b* CORNER COMMUNICATION HOLE
H2 VANE COMMUNICATION HOLE

The invention claimed is:

1. A combustor comprising:

a pilot burner;

a plurality of main burners positioned radially outward of the pilot burner and displaced along a circumferential direction about a longitudinal axis of the pilot burner, each of the main burners including a main nozzle disposed in a main burner cylinder;

a plurality of extension tubes, each of the extension tubes being located at a downstream side of the main burner cylinder of a respective one of the main burners, each of the extension tubes including an upstream circular inlet communicating with the respective main burner cylinder, and including a downstream trapezoidal outlet formed of two radial edges extending in a radial direction and two circumferential edges formed in the circumferential direction so as to connect radial outer ends and radial inner ends of the radial edges; and an air passage formed outside of the main burner cylinder;

wherein each of the extension tubes has an elongated slit-shaped inner communication hole formed to extend obliquely through a wall on a radially inner side of the upstream circular inlet of the respective extension tube and towards the downstream trapezoidal outlet, the inner communication hole being configured to allow the air passage to communicate with an interior of the respective extension tube at a radially inner circumferential edge of the respective extension tube, and wherein the inner communication hole is configured such that a center of an arc length of the elongated slit-shaped inner communication hole is shifted circumferentially from a central position of the radially inner circumferential edge.

2. A gas turbine comprising:

a compressor;

the combustor according to claim 1; and a turbine.

3. The combustor according to claim 1, further comprising:

a plurality of main swirlers radially extending in the main burner cylinder; and a vane communication hole formed at a position corresponding to a downstream end of the main swirlers to allow communication between the air passage and an interior of the main burner cylinder.

4. The combustor according to claim 1, wherein the elongated slit-shaped inner communication hole extends more than 30 degrees and less than 180 degrees in the circumferential direction.

5. The combustor according to claim 1, wherein each of the extension tubes further has a corner communication hole configured to allow the air passage to communicate with the interior of the respective extension tube, the corner communication hole being located at a radially outer circumferential edge of the inlet of the respective extension tube.

6. The combustor according to claim 5, wherein the inner communication hole extends in the circumferential direction, and the corner communication hole extends in the circumferential direction.

7. The combustor according to claim 6, wherein the inner communication hole is formed to have a larger aperture area than that of the corner communication hole.

8. The combustor according to claim 5, wherein the inner communication hole extends in the circumferential direction and the corner communication hole is one of a plurality of holes discontinuously arranged in the circumferential direction.

9. The combustor according to claim 5, wherein the corner communication hole is formed through the wall of the extension tube.

10. A combustor comprising:

a pilot burner;

a plurality of main burners positioned radially outward of the pilot burner and displaced along a circumferential direction about a longitudinal axis of the pilot burner, each of the main burners including a main nozzle disposed in a main burner cylinder;

a plurality of extension tubes, each of the extension tubes being located at a downstream side of the main burner cylinder of a respective one of the main burners, each of the extension tubes including an upstream circular inlet communicating with the respective main burner cylinder, and including a downstream trapezoidal outlet formed of two radial edges extending in a radial direction and two circumferential edges formed in the circumferential direction so as to connect radial outer ends and radial inner ends of the radial edges; and an air passage formed outside of the main burner cylinder;

wherein each of the extension tubes has an elongated slit-shaped corner communication hole formed to extend obliquely through a wall on a radially outer side of the upstream circular inlet of the respective extension tube and towards the downstream trapezoidal outlet, the corner communication hole being configured to allow the air passage to communicate with an interior of the respective extension tube at a radially outer circumferential edge of the respective extension tube, and wherein the corner communication hole is configured such that a center of an arc length of the elongated slit-shaped corner communication hole is shifted circumferentially from a central position of the radially outer circumferential edge.

11. The combustor according to claim 10, further comprising:

An inner communication hole configured to allow the air passage to communicate with the interior of the respective extension tube at the radially inner circumferential edge of the respective extension tube.

12. The combustor according to claim 10, wherein the elongated slit-shaped corner communication hole extends more than 30 degrees and less than 180 degrees in the circumferential direction.

* * * * *